US009057246B2

(12) United States Patent
O'Blenes

(10) Patent No.: US 9,057,246 B2
(45) Date of Patent: Jun. 16, 2015

(54) TUBULAR CATCHER SYSTEM AND METHOD

(71) Applicant: TESCO CORPORATION, Houston, TX (US)

(72) Inventor: Jonathan Brian O'Blenes, Calgary (CA)

(73) Assignee: Tesco Corporation, Houston, TX (US)

( * ) Notice: Subject to any disclaimer, the term of this patent is extended or adjusted under 35 U.S.C. 154(b) by 224 days.

(21) Appl. No.: 13/664,228

(22) Filed: Oct. 30, 2012

(65) Prior Publication Data

US 2013/0112479 A1 May 9, 2013

Related U.S. Application Data

(60) Provisional application No. 61/555,811, filed on Nov. 4, 2011.

(51) Int. Cl.

| | |
|---|---|
| ***E21B 40/00*** | (2006.01) |
| ***E21B 44/00*** | (2006.01) |
| ***E21B 23/01*** | (2006.01) |
| ***E21B 41/00*** | (2006.01) |
| ***E21B 19/16*** | (2006.01) |

(52) U.S. Cl.

CPC ..... *E21B 44/00* (2013.01); *E21B 23/01* (2013.01); *E21B 40/00* (2013.01); *E21B 41/0021* (2013.01); *E21B 19/165* (2013.01)

(58) Field of Classification Search

CPC ..... E21B 44/00; E21B 23/01; E21B 19/165; E21B 19/162; E21B 19/008; E21B 19/16; E21B 19/12; E21B 19/10; E21B 41/0021; E21B 40/00; E21B 47/09

USPC ..... 166/380, 77.51, 381, 77.52, 75.14, 53, 166/65.1; 175/40, 52; 414/22.63; 74/490.01

See application file for complete search history.

(56) References Cited

U.S. PATENT DOCUMENTS

2009/0159294 A1* 6/2009 Abdollahi et al. ..... 166/377
2009/0260797 A1* 10/2009 Doud et al. ..... 166/53

FOREIGN PATENT DOCUMENTS

| | | |
|---|---|---|
| CA | 2553460 | 11/2006 |
| WO | 0190530 | 11/2001 |

OTHER PUBLICATIONS

International Search Report & Written Opinion for PCT International Application No. PCT/US2012/062771 mailed Nov. 26, 2013.

* cited by examiner

*Primary Examiner* — Yong-Suk (Philip) Ro
(74) *Attorney, Agent, or Firm* — Fletcher Yoder, P.C.

(57) ABSTRACT

Present embodiments are directed to a tubular catcher system configured to detect a falling tubular through a drilling rig and grip the tubular before it drops into the wellbore. A sensor configured to detect the velocity or acceleration of the tubular activates an actuation mechanism when the velocity or acceleration exceeds a specific threshold, indicating a falling tubular. The actuation mechanism forces a gripping mechanism into contact with the tubular, catching the tubular and sending energy from the tubular to a hydropneumatic shock absorber coupled to the actuation mechanism and/or the gripping mechanism.

18 Claims, 8 Drawing Sheets

TUBULAR CATCHER SYSTEM AND METHOD

CROSS REFERENCE TO RELATED APPLICATIONS

This application claims priority from and the benefit of U.S. Provisional Application Ser. No. 61/555,811, entitled "Tubular Catcher System and Method," filed Nov. 4, 2011, which is hereby incorporated by reference for all purposes.

BACKGROUND

The invention relates generally to the field of drilling and processing of wells, and, more particularly, to a system and method for catching tubular that is dropped during a casing process, a drilling process, or another type of well processing operation.

In conventional oil and gas operations, a well is typically drilled to a desired depth with a drill string, which includes drill pipe and a drilling bottom hole assembly. Once the desired depth is reached, the drill string is removed from the hole and casing is run into the vacant hole. Casing may be defined as pipe or tubular that is placed in a well to prevent the well from caving in, to contain fluids, and to assist with efficient extraction of product. Tubular may be defined as including drill pipe, casing, or any other type of tubular utilized in drilling or well processing operations.

During drilling and casing running operations, a string of tubular (e.g., drill pipe or casing) is typically held by slips mounted to the rig floor while a new length of tubular is connected. Specifically in casing operations, a new length of tubular is positioned above the floor mounted tubular string by a special elevator while connections are made up at the rig floor level. The tubular is held in place by the slips while a top drive is lowered onto the upper end of the tubular. The tubular is then hoisted upward by the top drive, shifting the entire tubular string weight to the top drive, and the slips are removed so that the new length of tubular can be carefully lowered into the wellbore.

Occasionally, the coordination between gripping of the tubular with the top drive (or with a casing drive system attached to the top drive) and release of the slips fails, resulting in the tubular dropping through the rig floor and down the well. Other scenarios can also lead to a dropped tubular. This type of event is usually costly and, in instances where the tubular cannot be salvaged, may result in abandoning the well. Accordingly, it is now recognized that there exists a need for a system and method for catching tubular dropped during drilling operations, casing operations, and the like.

BRIEF DESCRIPTION

The present invention is designed to respond to such a need. In accordance with one aspect of the invention, a drilling system comprises a sensor configured to detect the motion of a tubular, a gripping mechanism to stop the downward motion of a tubular dropping toward a wellbore, an actuation mechanism to close the gripping mechanism against the tubular, and a trigger mechanism to activate the actuation mechanism when the sensor recognizes that the tubular is dropping too quickly. The drilling system also includes a shock absorber to transfer energy from the falling tubular through a support structure and to the ground.

The invention also provides a tubular catching method. In an exemplary embodiment, the method comprises sensing a velocity or acceleration of a tubular into a wellbore, activating an actuation mechanism when the sensed velocity or acceleration exceeds a threshold, and engaging the tubular with a gripping mechanism. The method also includes resisting downward momentum of the tubular with a shock absorber coupled to the actuation mechanism and/or gripping mechanism and, ultimately, preventing the tubular from dropping into the wellbore.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The present invention provides a novel tubular catcher system and method that can be used in casing and drilling operations. The presently disclosed techniques allow for a dropped tubular (e.g., string of casing or drill pipe) to be grasped before falling into a wellbore. In one embodiment, a sensor detects the velocity or acceleration of the tubular, and activates an actuation mechanism when the velocity or acceleration reaches a threshold (indicating a free-falling tubular). The actuation mechanism then forces a gripping mechanism to engage with the falling tubular in order to stop the downward motion, and a shock absorber dissipates the energy from the falling tubular.

Figure 1:
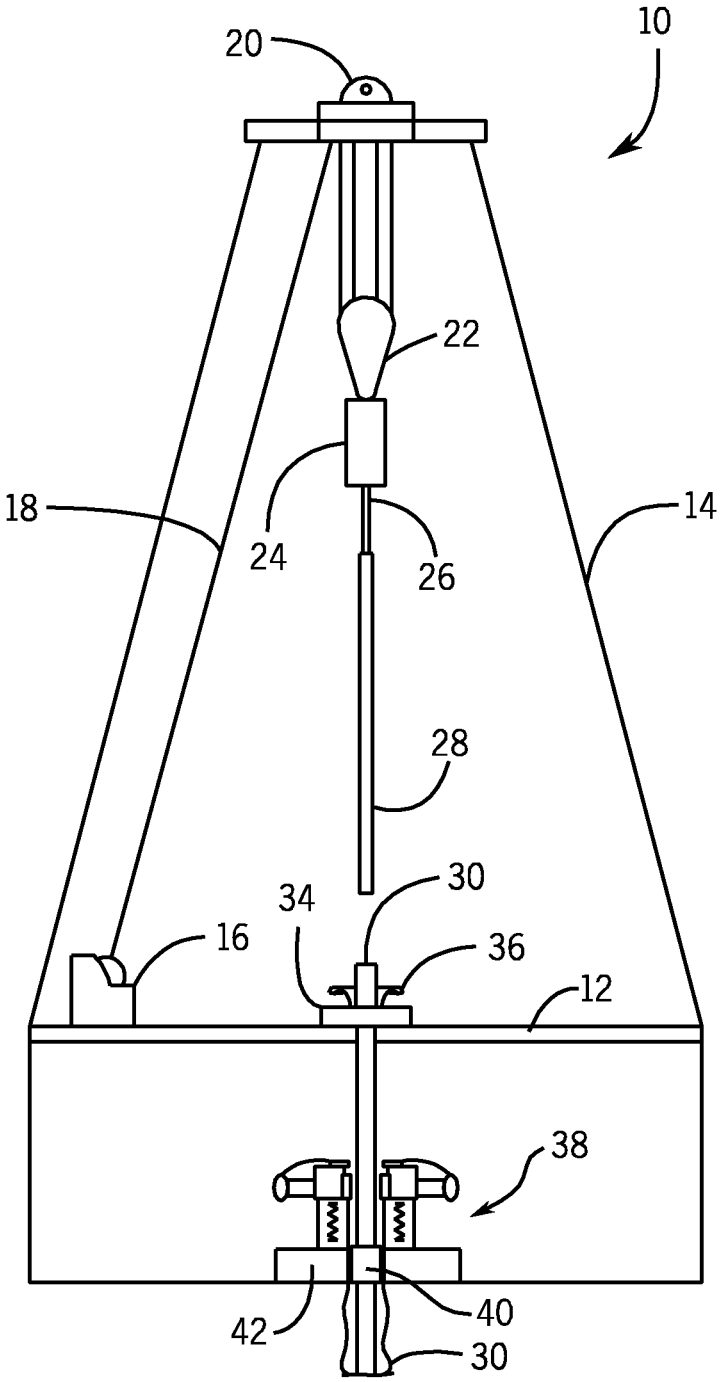
FIG. 1 is a schematic representation of a well being drilled in accordance with present techniques.

Turning now to the drawings, FIG. 1 is a schematic representation of a drilling rig 10 in the process of drilling a well in accordance embodiments of the present techniques. The drilling rig 10 features an elevated rig floor 12 and a derrick 14 extending above the floor. A drawworks 16 supplies drilling line 18 to a crown block 20 and traveling block 22 in order to hoist various types of drilling equipment above the rig floor 12. The traveling block 22 supports a top drive 24, which is connected to a casing drive system 26, and these drive systems make connections with tubular lengths 28 as they are added to the tubular 30 that extends into the wellbore 32. The tubular length 28 can refer to either a length of casing or drill pipe, and the tubular 30 is the total length of connected casing or drill pipe that extends into the wellbore 32 at a given moment. Once the connection has been made between a new tubular length and the tubular at the rig floor level, the length 28 effectively becomes part of the tubular 30.

While a new tubular length 28 is being attached to the tubular 30, the tubular 30 is held stationary with respect to the rig floor 12 by a rotary table 34 and slips 36. The tubular 30 extends below the rig floor 12 and through a catcher system 38 in accordance with present embodiments. The tubular 30 then passes through a blow-out preventer 40 before extending into the wellbore 32 at the ground level. A ground support structure 42 is disposed around the blow-out preventer 40 to support the catcher system 38. It should be noted that FIG. 1 is merely a representative embodiment. Certain features of FIG. 1 may be different in other embodiments. For example, various different embodiments of the catcher system 38 will be discussed in greater detail below.

It should be noted that the drilling rig 10 illustrated in FIG. 1 is intentionally simplified to focus on the catcher system 38 described in the present disclosure. Many other components and tools may be employed during the various periods of formation and preparation of the wellbore 32. Similarly, as will be appreciated by those skilled in the art, the environment of the wellbore 32 may vary widely depending upon the location and situation of the formations of interest. For example, rather than a surface (land-based) operation, the wellbore 32 may be formed under water of various depths, in which case the topside equipment may include an anchored or floating platform, and some of the components used may be positioned at or near a point where the well enters the earth at the bottom of a body of water. Specifically, for example, the blow-out preventer 40 may be positioned on an ocean bottom when the drilling rig 10 is a component of an offshore platform.

Figure 2:
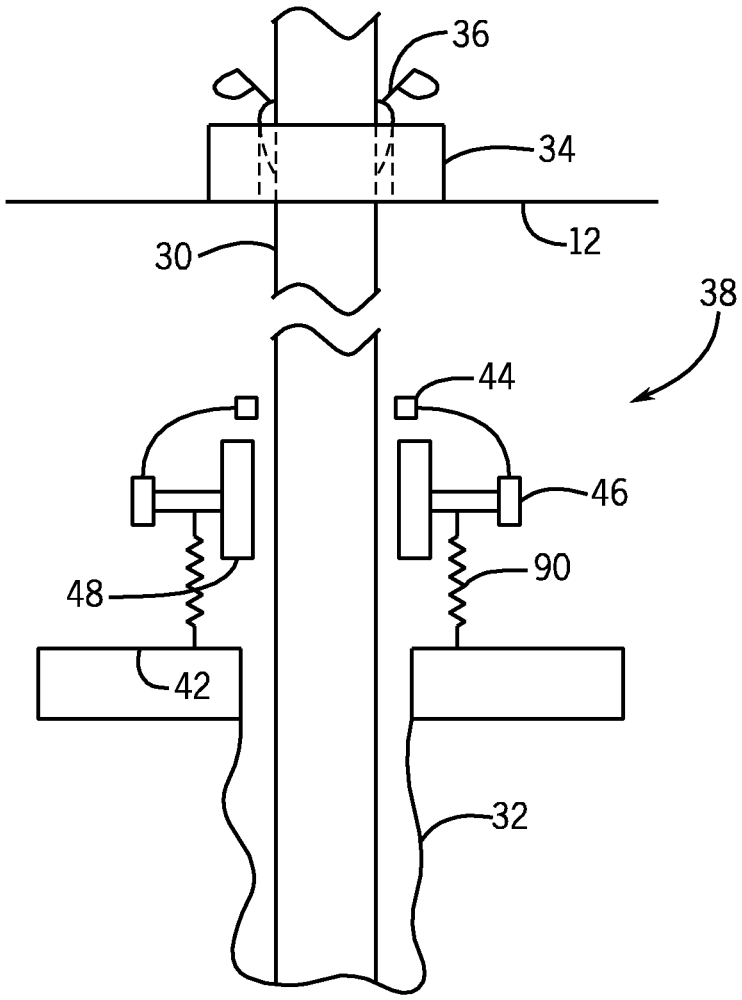
FIG. 2 is a simplified diagrammatical view of certain exemplary functional components of a tubular catcher system in accordance with present techniques.

FIG. 2, which is a detailed schematic of the catcher system 38 of FIG. 1, illustrates features that together may be utilized to prevent the tubular 30 from dropping uncontrollably into the wellbore 32, in the event that the tubular 30 is not fully connected to the top drive 24 when the slips 36 are removed from the rotary table 34. The catcher system 38 includes a sensor 44 configured to detect the movement (e.g., velocity or acceleration) of the tubular 30 and activate an actuation mechanism 46 when the detected movement of the tubular 30 exceeds a threshold. When activated, the actuation mechanism 46 forces a gripping mechanism 48 into engagement with the descending tubular 30 in order to halt its downward motion. Multiple configurations exist for the implementation of the sensor 44, gripping mechanism 48, and actuation mechanism 46, and examples of these configurations are discussed in detail below with respect to corresponding figures. The actuation mechanism 46 and gripping mechanism 48 together may be referred to as an actuatable gripping mechanism.

Figure 3:
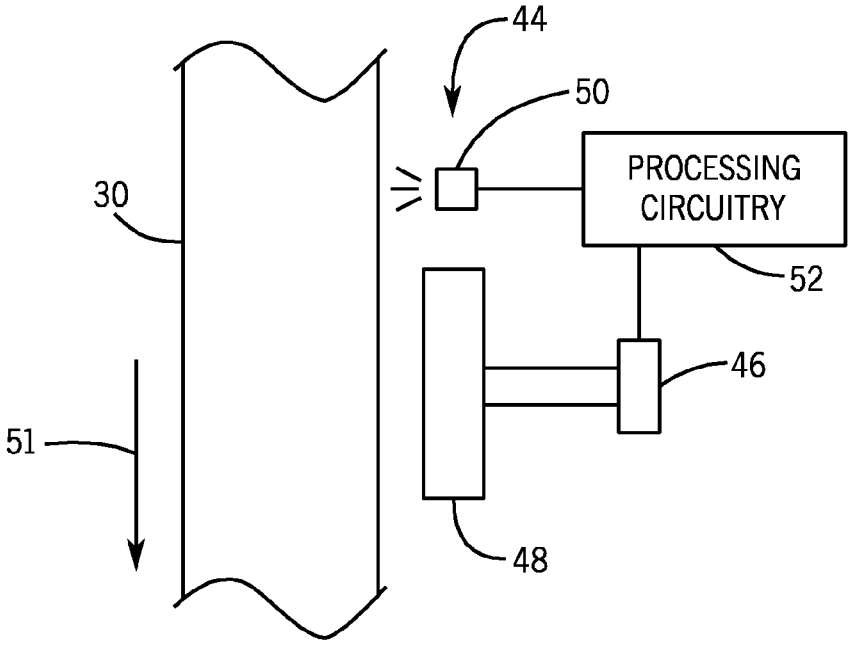
FIG. 3 is a schematic representation of certain exemplary functional components of a tubular catcher system, including an optical sensor in accordance with present techniques.

As shown in FIG. 3, the sensor 44 may be an electronic, optical sensor 50 configured to detect velocity or acceleration of the tubular 30. Also, as illustrated in FIG. 3, the tubular 30 is moving downward, as represented by arrow 51. The optical sensor 50 may collect images of the moving tubular 30 and communicate these images to processing circuitry 52 that operates to determine, from the sensor images, the velocity or acceleration of the tubular 30. When a velocity or acceleration threshold is exceeded, the processing circuitry 52 sends an electrical signal to activate the actuation mechanism 46, which moves the gripping mechanism 48 into engagement with the tubular 30. Thus, the processing circuitry 52 works as a triggering mechanism to provide an electrical signal to activate the actuation mechanism 46.

The velocity or acceleration threshold may be exactly defined (e.g., tubular traveling at the acceleration of gravity or 9.8 meters per second squared in the downward direction) or relatively defined (e.g., tubular traveling five meters per second faster than the speed of the top drive 24 or another coupling device in the downward direction). Indeed, in accordance with present embodiments, the top drive 24 may include a mechanism for detecting a velocity of acceleration that is being imparted to the tubing 30 by the top drive 24. When this value is known, it can be utilized as a threshold to determine whether the tubular 30 is moving independently of the top drive 24. If there is a difference in the movement of the tubular 30 measured by the sensor 44 and the movement that should be imparted by the top drive 24, the movement of the tubular 30 may be identified a falling. As a specific example, if the top drive 24 indicates that the tubular 30 should be moving upwards (e.g., a positive movement of 1.5 meters per second) and the sensor 44 detects that the tubular 30 is moving downward (e.g., a negative movement of 0.5 meters per second), the catcher system 38 may operate to secure the tubular 30 to prevent further movement in the negative direction.

Figure 4:
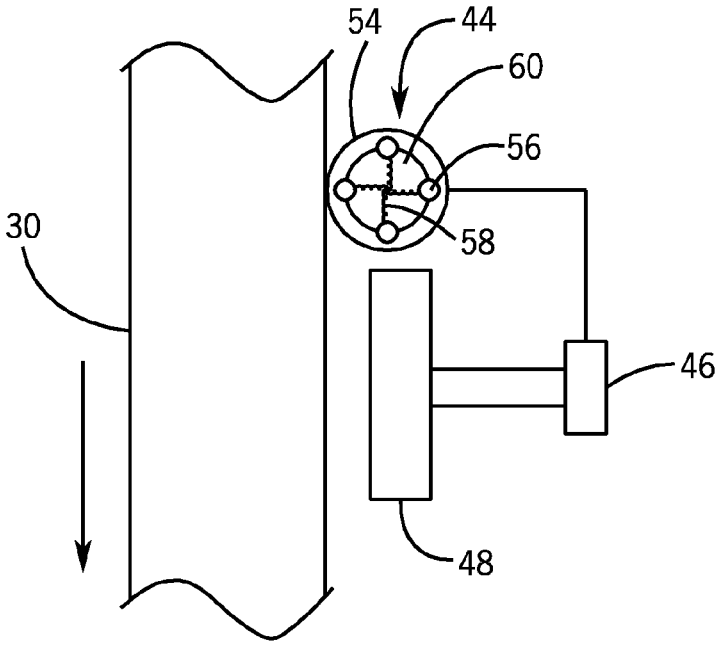
FIG. 4 is a schematic representation of certain exemplary functional components of a tubular catcher system, including a mechanical sensor with an inertia roller in accordance with present techniques.

FIG. 4 illustrates an embodiment wherein the sensor 44 is a mechanical sensor comprising an inertia roller 54. This inertia roller 54 may maintain rolling contact with the tubular 30 or may turn on a shaft that is connected through a gear train to a roller that maintains rolling contact with the tubular. With either arrangement, a threshold velocity or acceleration of the tubular 30 traveling into the wellbore corresponds to a threshold angular velocity or acceleration of the inertia roller 54. The inertia roller 54 may include a number of weights 56 positioned around its outside edge and held in place by coil springs 58 or the like. When the inertia roller 54 is at rest, the weights 56 hold a plate 60 a distance away from two electrical contacts that form part of a circuit. The weights 56 and springs 58 are calibrated such that the weights 56 swing outward, due to centrifugal force overcoming the spring force, when the roller 54 turns at the threshold angular velocity or acceleration. As the weights 56 swing outward, the plate 60 lifts up, completing the circuit that sends an electrical signal to activate the actuation mechanism 46. In other embodiments, different mechanical features may be employed for detecting motion of the tubular 30 with the sensor 44.

It should be noted that determining and sensing an acceleration threshold may be more desirable than determining and sensing a velocity threshold in certain situations. For example, the tubular 30, consisting of a number of lengths of pipe or casing connected together, may weigh up to five hundred thousand (500,000) pounds. Much of the total length of the tubular 30 may be inside the wellbore 32 at a given moment, with approximately ninety feet (three lengths) of tubular above the rig floor 12 in some embodiments. With this weight freefalling into the wellbore 32 and so little length available for the gripping mechanism 48 to engage, it is desirable to utilize sensors 44 that detect a dropped tubular nearly instantaneously. Upon being released into a freefall, the tubular 30 immediately accelerates at a generally known rate of gravity (e.g., 9.8 meters per second squared), but takes more time to reach a threshold velocity since it must accelerate to that velocity. Accordingly, detecting acceleration and using a threshold corresponding to gravity may enable a more rapid activation of the catcher system 38 than embodiments that utilize velocity.

Figure 5:
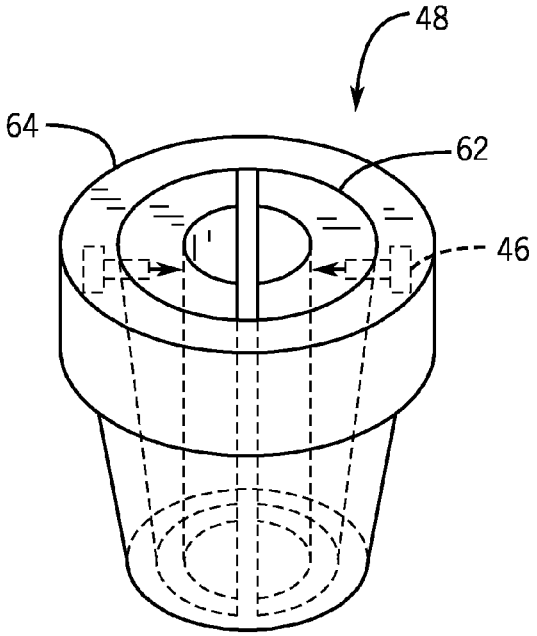
FIG. 5 is a perspective view of a gripping mechanism including actuated slips in accordance with present techniques.

FIG. 5 is a detailed view of one configuration of the gripping mechanism 48 of FIG. 2, used to engage with the falling tubular 30 in order to halt the downward motion of the tubular 30. The gripping mechanism 48 may comprise actuatable slips 62 that act much like the floor mounted slips 36 shown in FIG. 2, wedging between the tubular 30 and a stationary slips mount 64. The actuation mechanism 46 may be disposed inside the slips mount 64. In FIG. 5, the actuated slips 62 are shown in the open position, allowing space for the tubular 30 to pass through without contacting the actuatable slips 62. When the tubular 30 is determined to be falling, the sensor 44 will activate the actuation mechanism 46, which will force the slips 62 to come together and engage with the tubular 30. The actuated slips 62 will halt the downward motion of the tubular 30 by wedging against the slips mount 64 in a frictional and/or deforming engagement.

Figure 6:
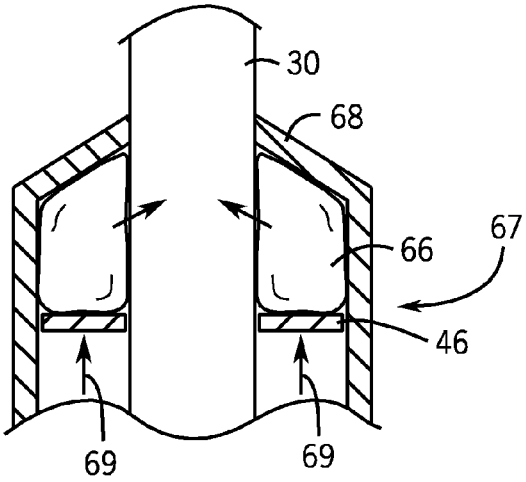
FIG. 6 is a section view of a gripping mechanism including a flexible annulus in accordance with present techniques.

FIG. 6, which is a section view of another configuration of the gripping mechanism 48, illustrates a flexible annulus 66 configured to halt the downward motion of a falling tubular 30. The flexible annulus 66 may comprise an annular shaped elastomeric material reinforced with steel and disposed in a chamber 67 around the tubular 30. A sloped or generally spherical wall 68 of the chamber 67 guides the flexible annulus 66 into contact with the tubular 30 when the flexible annulus 66 is forced upward by the actuation mechanism 46, as indicated by arrows 69. The force of this gripping mechanism 48, upon application to the falling tubular 30, may damage or deform the tubular 30 in an effort to resist the falling motion. Damage incurred by the tubular 30 at the site of engagement with the gripping mechanism 48 is preferable to loss of the entire tubular 30 down the wellbore 32, because the caught tubular 30 may be salvageable with only one or two lengths of tubular requiring replacement.

Figure 7:
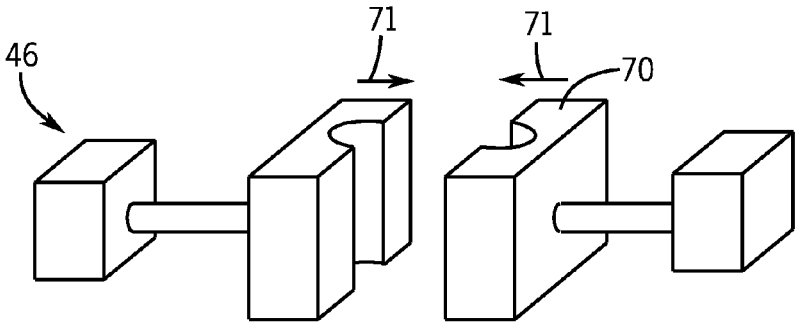
FIG. 7 is a perspective view of a gripping mechanism including clamping rams in accordance with present techniques.

FIG. 7 illustrates clamping rams 70, a third configuration of the gripping mechanism 48 described in FIG. 2. These clamping rams 70 may feature an inner diameter slightly less than the outer diameter of the tubular 30 and may remain disposed a distance away from the tubular 30 unless forced together by the actuation mechanism 46, as indicated by arrows 71. As with the previously discussed flexible annulus 66, the clamping rams 70 may damage the tubular 30 upon contact, but this is permissible since the primary goal is to catch the tubular 30 and prevent it from becoming irretrievable.

Figure 8:
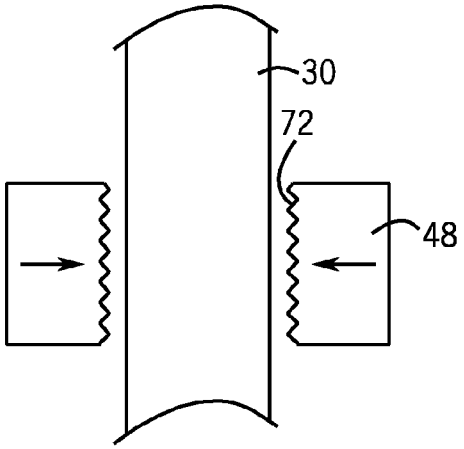
FIG. 8 is a schematic representation of a gripping mechanism with teeth in accordance with present techniques.

FIG. 8 is a schematic indicating that the gripping mechanism 48 may feature teeth 72 to increase effectiveness of engagement with the tubular 30. The teeth 72 may increase friction between the falling tubular 30 and the gripping mechanism 48, further decreasing the downward momentum of the tubular 30. Additionally, the teeth 72 may extend contact between the tubular 30 and the gripping mechanism 48 into the tubular 30 without risking shearing the tubular 30. The teeth 72 may be applied to the actuated slips 62 of FIG. 5 or the clamping rams 70 of FIG. 7. Similarly, other embodiments may utilize the teeth 72 to facilitate engagement between the gripping mechanism 48 and the tubular 30 when the catcher system 48 is activated.

Figure 9:
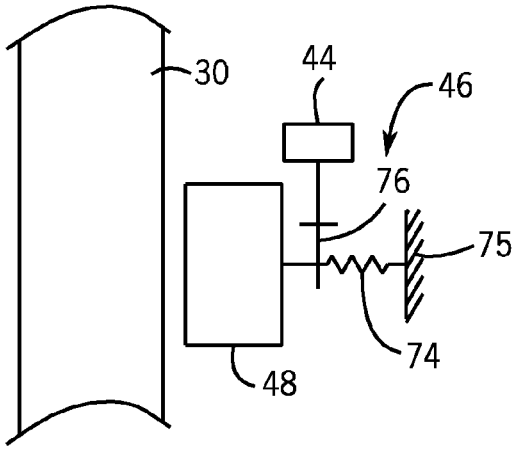
FIG. 9 is a schematic representation of certain exemplary functional components of a tubular catcher system, including a loaded spring actuation mechanism with mechanical trigger in accordance with present techniques.

As shown in FIG. 2, in order to engage the gripping mechanism 48 with a falling tubular 30, the sensor 44 must activate an actuation mechanism 46 when the velocity or acceleration of the tubular 30 reaches a threshold. Several configurations of the actuation mechanism 46 may be employed in accordance with present embodiments, and certain configurations described herein may be more suitable for actuating certain gripping mechanisms (slips, rams, etc.). FIG. 9 shows one such actuation mechanism 46 comprising a loaded spring 74 coupled to the gripping mechanism 48 and mounted against a stationary support structure 75. This support structure 75 may be part of the drilling rig's support structure or integrated with the earth to provide sufficient support. A trigger mechanism, trigger device, or load-release 76 may hold the spring 74 in the loaded position and, when removed, trigger a release of the spring's energy to force the gripping mechanism 48 toward the tubular 30. The load-release 76 may be removed from the spring 74 through electromechanical coupling with the electrical signal sent from the sensor 44. In other embodiments, different configurations may be employed. For example, in some embodiments, the trigger mechanism or load-release 76 may include a latch.

Figure 10:
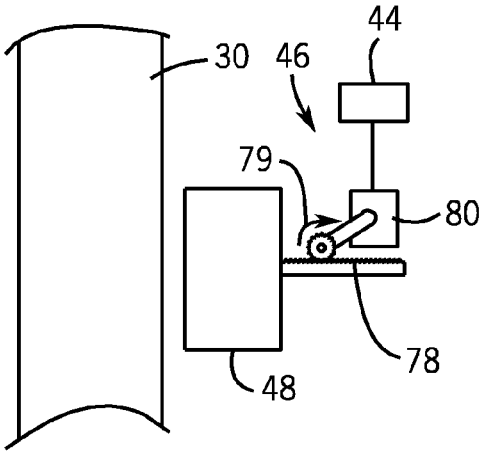
FIG. 10 is a schematic representation of certain exemplary functional components of a tubular catcher system, including a rack and pinion actuation mechanism in accordance with present techniques.

As another example, the actuation mechanism 46 may include a motor-actuated system. Specifically, for example, the actuation mechanism 46 illustrated in FIG. 10 comprises a rack 78 and pinion 79 coupled to the gripping mechanism 48 and powered by a motor 80. The motor 80, which turns the pinion 79, receives a signal from the sensor 44 when the movement of the tubular 30 exceeds a velocity or acceleration threshold. The transmission of the signal may be controlled by the trigger mechanism 76 that is activated based on the threshold, and this trigger mechanism 76 may be included in the sensor 44. The rotational movement of the motor 80 is transferred to translational movement by the rack 78 and pinion 79, and the rack 78 forces the gripping mechanism 48 into engagement with the falling tubular 30.

Figure 11:
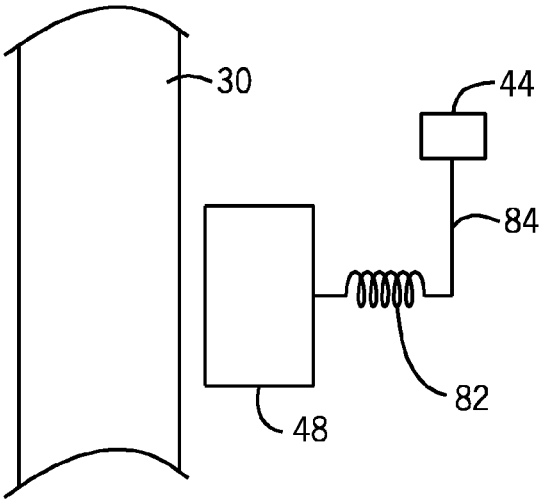
FIG. 11 is a schematic representation of certain exemplary functional components of a tubular catcher system, including a solenoid actuation mechanism with a current-carrying wire trigger in accordance with present techniques.

In yet another embodiment, the actuation mechanism 46 may include an electromagnetic device. For example, FIG. 11 is a schematic including certain functional components of the catcher system 38 shown in FIG. 2, wherein the actuation mechanism 46 comprises a solenoid 82. The solenoid 82 is mechanically coupled to the gripping mechanism 48 and electrically coupled to the sensor 44 via a current-carrying wire 84. When activated (e.g., by the triggering mechanism 76, which may be an aspect of the sensor 44 or another component), a current travels through the current-carrying wire 84 to the solenoid 82 from the sensor 44 in response to a falling tubular 30, causing the solenoid coil to lengthen and force the gripping mechanism 48 into contact with the tubular 30.

Figure 12:
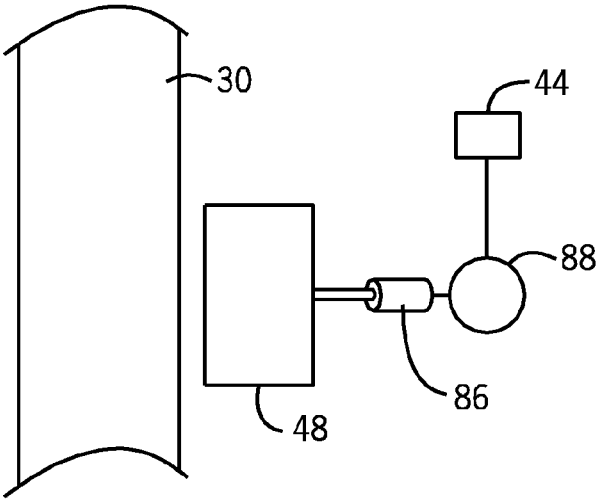
FIG. 12 is a schematic representation of certain exemplary functional components of a tubular catcher system, including a hydraulic actuation mechanism in accordance with present techniques.

In still other embodiments, hydraulics may be employed with the actuation mechanism 46. For example, FIG. 12 illustrates functional components of the catcher system 38 introduced in FIG. 2, wherein the actuation mechanism 46 comprises a hydraulic actuator 86 and hydraulic fluid pump 88. The hydraulic fluid pump 88 generates a flow rate regulated by an electrical signal sent from the sensor 44 in response to the detected velocity or acceleration of the tubular 30 into the wellbore 32. The hydraulic actuator 86 features a piston, coupled to the gripping mechanism 48, that moves in response to hydraulic fluid supplied to the chamber of the hydraulic actuator 86 by the fluid pump 88.

It should be noted that although FIGS. 9-12 each illustrate an actuation mechanism 46 forcing a gripping mechanism 48 laterally into engagement with a tubular 30, other arrangements of these features are envisioned in accordance with present techniques. For example, certain actuation mechanisms 46 may be disposed such that actuation takes place parallel to the tubular 30 instead of perpendicular to the tubular. Such an arrangement is illustrated in FIG. 6, which includes an actuation mechanism 46 that moves in parallel with the tubular 30 in order to cause the flexible annulus 66 or gripping mechanism 48 to engage the tubular 30. In addition, the actuation mechanism 46 in each of FIGS. 9-12 is generally shown on one side of the tubular 30 only, though it should be noted that the gripping mechanism 48 may include one or more components and actuation of the gripping mechanism 48 may take place from at least two sides of the tubular 30.

Turning back to FIG. 2, the tubular catching system or catcher system 38 comprises a shock absorber 90, in addition to the sensor 44, the actuation mechanism 46, and the gripping mechanism 48. The shock absorber 90 may be coupled to the actuation mechanism 46 and/or the gripping mechanism 48 and configured to dissipate the energy transferred from the dropped tubular 30 to the gripping mechanism 48 and/or actuation mechanism 46. As mentioned previously, the tubular 30 may weigh a large amount (e.g., five hundred thousand pounds), and this much weight under gravitational acceleration possesses a large amount of kinetic energy after dropping only a short distance. An effective catcher system 38 will transfer all the kinetic energy to its own components in order to halt the downward movement of the tubular 30. Therefore it is desirable to have a shock absorber 90 configured to dissipate kinetic energy so that components of the catcher system 38 (gripping mechanism, actuation mechanism, etc.) are not destroyed or pulled toward the wellbore 32 upon engagement with the tubular 30.

Figure 13:
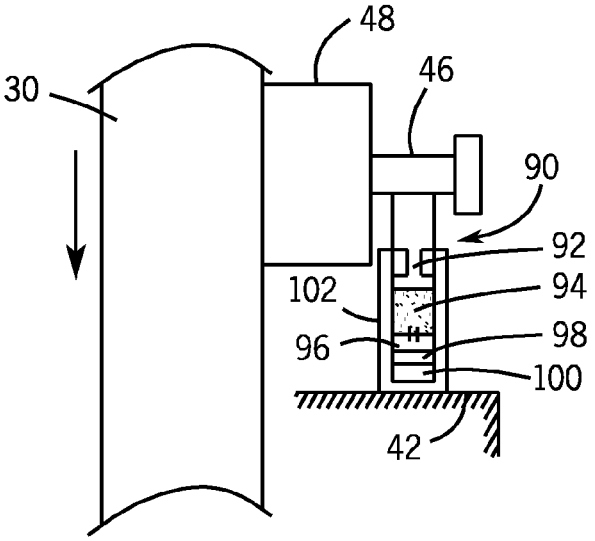
FIG. 13 is a schematic representation of certain exemplary functional components of a tubular catcher system, including a hydropneumatic shock absorber in accordance with present techniques.
Figure 14:
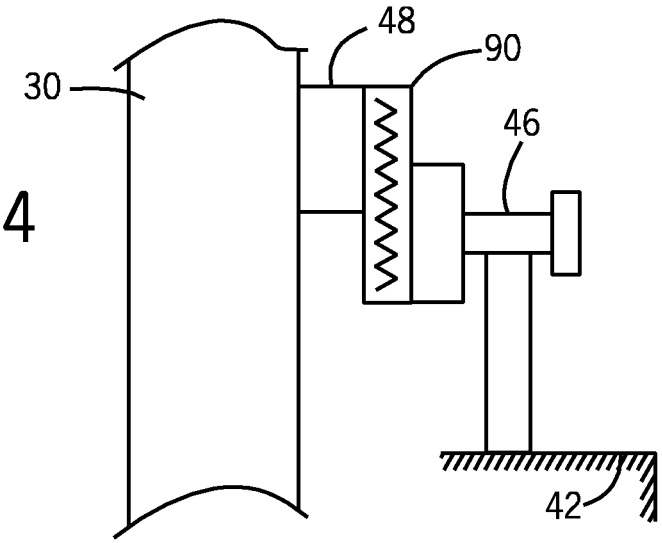
FIG. 14 is a schematic representation of certain exemplary functional components of a tubular catcher system, including a shock absorber coupled with an actuation mechanism and a gripping mechanism in accordance with present techniques.

The shock absorber 90 may include various different shock absorbing mechanisms in accordance with present embodiments. For example, FIG. 13 is a detailed schematic representation of the shock absorber 90 of FIG. 2 including a hydropneumatic shock absorption feature, in accordance with the present invention. As illustrated in FIG. 13, the shock absorber 90 comprises a piston rod 92 coupled to the actuation mechanism 46, a chamber of hydraulic fluid 94, a second chamber 96, a free-floating piston 98, and a volume of compressed fluid 100 (e.g., air), all disposed inside a housing 102 that is coupled to the ground support structure 42. As energy from the falling tubular 30 transfers to the gripping mechanism 48 and the actuation mechanism 46, the actuation mechanism 46 pushes down on the piston rod 92. The piston rod 92 pushes hydraulic fluid from the fluid chamber 94 into the second chamber 96 through a small orifice in a wall between the two chambers. Hydraulic fluid in the second chamber 96 then pushes on the free-floating piston 98, which separates the second chamber 96 of hydraulic fluid from the confined volume of compressed fluid 100. The downward motion of the piston rod 92 and actuation mechanism 46 is resisted by the hydraulic fluid and compressed fluid 100 of the hydropneumatic shock absorber 90, and energy of the tubular 30 dissipates as heat transferred to the hydraulic fluid. Energy from the tubular 30 that is not dissipated as heat transfers to the ground support structure 42, which may also include part of the support structure of the drilling rig 10. Although the shock absorber 90 is illustrated only on one side of the tubular 30, shock absorption may take place through multiple hydropneumatic shock absorbers coupled to the actuation mechanism 46 or gripping mechanism 48 on multiple sides of the tubular or through an annular shock absorber disposed around the tubular, for which FIG. 13 acts as a sectional view. As an example, FIG. 14 illustrates an embodiment, wherein the shock absorber 90 is coupled with the gripping mechanism 48.

Figure 15:
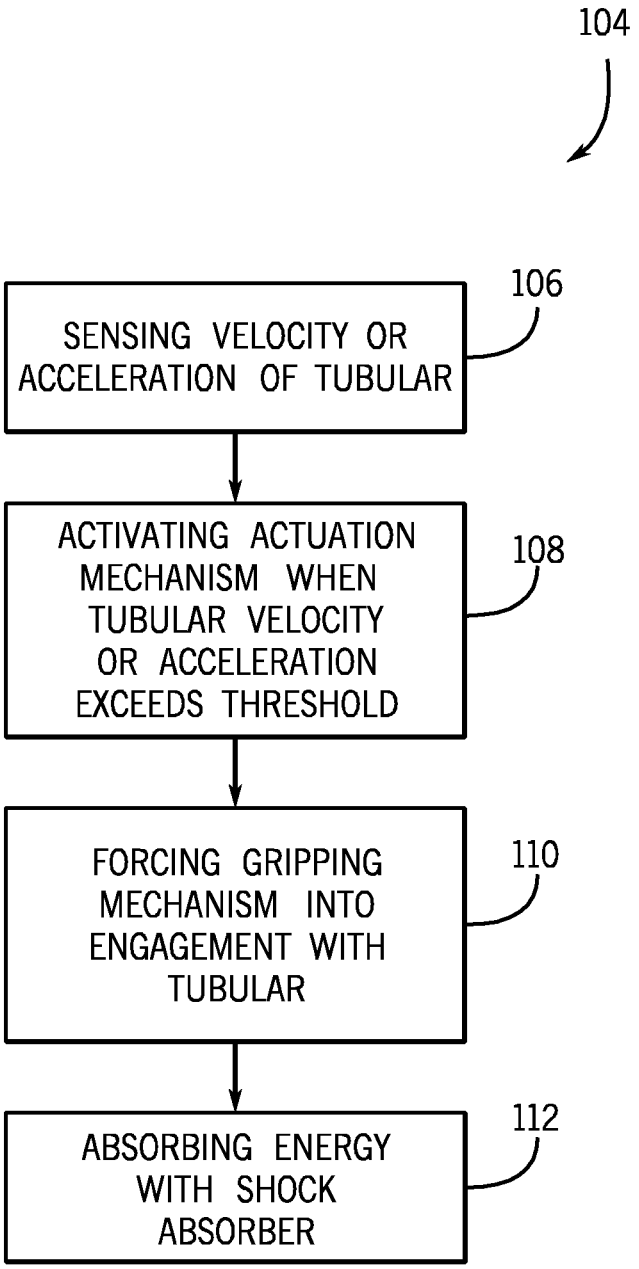
FIG. 15 is a process flow diagram of a method in accordance with present techniques.

FIG. 15 illustrates a method 104 in accordance with embodiments of the present disclosure. The method 104 includes detecting the velocity or acceleration of a tubular through a drilling rig with a sensor, which may be an optical sensor or a mechanical sensor, as represented by block 106. Further, the method includes activating an actuation mechanism when the sensed velocity or acceleration exceeds a threshold, as represented by block 108. This may include activation of the actuation mechanism by a trigger mechanism (e.g., trigger mechanism 76), which may include any of various different types of features that are activated by a threshold velocity or acceleration. The actuation mechanism may be a loaded coil spring, a rack and pinion powered by a motor, a solenoid supplied with electrical current, or a hydraulic cylinder controlled by a pump. Further, as represented by block 110, the method includes forcing a gripping mechanism, which may comprise slips, rams, or a flexible annulus, into engagement with a tubular in order to prevent the tubular from falling down the wellbore. The actuation mechanism forces the gripping mechanism into contact with the tubular, and the contact area of the tubular may become damaged in the process. Still further, the method includes absorbing energy that is transferred from the tubular to the gripping mechanism and/or the actuation mechanism through a shock absorber, as represented by block 112. Specifically, the translational energy transferred to the actuation mechanism pushes a piston rod into a housing that holds various chambers of hydraulic fluid and compressed air, and the energy is dissipated as heat. The shock absorber, coupled to a ground support system, transfers any remaining energy into the support system and the ground.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A drilling system, comprising:

a sensor configured to detect velocity or acceleration of a tubular through a drilling rig;

a gripping mechanism configured to engage with the tubular;

an actuation mechanism coupled with the gripping mechanism and configured to force the gripping mechanism into engagement with the tubular;

a trigger mechanism configured to activate the actuation mechanism in response to the velocity or acceleration detected by the sensor exceeding a velocity or acceleration threshold;

a shock absorber configured to absorb energy transferred to the gripping mechanism from the tubular as the gripping mechanism is engaged with the tubular; and a support structure coupled to the shock absorber.

2. The drilling system of claim 1, wherein the sensor comprises an optical sensor.

3. The drilling system of claim 1, wherein the sensor comprises a mechanical sensor including an inertia roller configured to be actuated in response to the inertia roller moving at a speed or acceleration corresponding to the threshold.

4. The drilling system of claim 1, wherein the trigger mechanism comprises circuitry configured to provide an electrical signal to activate the actuation mechanism.

5. The drilling system of claim 1, wherein the trigger mechanism comprises a latch configured to activate the actuation mechanism by releasing from engagement with the actuation mechanism.

6. The drilling system of claim 1, wherein the actuation mechanism comprises a loaded spring, a rack and pinion, a solenoid, or a hydraulic actuator.

7. The drilling system of claim 1, wherein the shock absorber comprises a hydropneumatic shock absorber.

8. The drilling system of claim 1, wherein the gripping mechanism comprises one or more clamping rams or slips.

9. The drilling system of claim 1, wherein the gripping mechanism comprises a flexible annulus.

10. A method, comprising:

detecting velocity or acceleration of a tubular through a drilling rig with a sensor;

activating an actuation mechanism coupled to a gripping mechanism in response to the velocity or acceleration detected by the sensor exceeding a velocity or acceleration threshold;

forcing the gripping mechanism into engagement with the tubular with the actuation mechanism; and absorbing energy transferred to the gripping mechanism from the tubular with a shock absorber as the gripping mechanism is engaged with the tubular.

11. The method of claim 10, comprising supporting the weight of the tubular with a support structure coupled to the shock absorber.

12. The method of claim 10, comprising activating an inertia roller in a mechanical sensor by swinging out spring mounted weights in response to the inertia roller rotating at a velocity or acceleration corresponding to the threshold.

13. The method of claim 10, comprising activating the actuation mechanism by releasing a latch coupled to the sensor from engagement with the actuation mechanism.

14. The method of claim 10, comprising forcing the gripping mechanism by releasing a loaded spring coupled to the gripping mechanism.

15. The method of claim 10, comprising forcing the gripping mechanism by turning a pinion engaged with a rack coupled to the gripping mechanism.

16. The method of claim 10, comprising forcing the gripping mechanism by flowing current through a solenoid coupled to the gripping mechanism or pumping hydraulic fluid into a hydraulic actuator coupled to the gripping mechanism.

17. A drilling system, comprising:

a trigger device configured to be activated by detection of acceleration or velocity of tubular relative to a tubular coupling device exceeding an acceleration or velocity threshold;

an actuatable gripping mechanism configured to engage with the tubular upon activation of the trigger device;

a support structure; and a shock absorber coupled to the support structure and the actuatable gripping mechanism, wherein the shock absorber is configured to absorb energy transferred to the actuatable gripping mechanism from the tubular as the actuatable gripping mechanism is engaged with the tubular.

18. The drilling system of claim 17, comprising:

a sensor configured to detect the acceleration or velocity of the tubular relative to the tubular coupling device and communicate with the trigger device; and the tubular coupling device, wherein the tubular coupling device comprises a top drive.

* * * * *